US005809649A

United States Patent [19]

Köstermeier

[11] Patent Number: 5,809,649

[45] Date of Patent: Sep. 22, 1998

[54] METHOD FOR THE MANUFACTURE OF A MACHINE PART HAVING EXTERNAL TOOTHING

[75] Inventor: Karl-Heinz Köstermeier, Rietberg, Germany

[73] Assignee: Leico GmbH & Co. Werkzeugmaschinenbau, Ahlen, Germany

[21] Appl. No.: 801,465

[22] Filed: Feb. 18, 1997

[30] Foreign Application Priority Data

Feb. 15, 1996 [DE] Germany ..... 196 05 645.4

[51] Int. Cl.[6] ..... B21D 53/28

[52] U.S. Cl. ..... 29/893.32; 72/110; 74/449; 74/457; 74/460

[58] Field of Search ..... 29/893.3, 893.32, 29/893.35; 72/68, 110, 111; 74/449, 457, 460

[56] References Cited

U.S. PATENT DOCUMENTS 5,072,509 12/1991 Bichel et al. ..... 29/892.3
5,237,744 8/1993 Himmeroeder ..... 72/68
5,699,689 12/1997 Yamanaka ..... 72/68

FOREIGN PATENT DOCUMENTS 379364 7/1990 European Pat. Off. ..... 74/449
4205711 4/1994 Germany .

*Primary Examiner*—P. W. Echols
*Attorney, Agent, or Firm*—Oblon, Spivak, McClelland, Maier & Neustadt, P.C.

[57] ABSTRACT

A method for the manufacture of a machine part with external toothing from a circular sheet metal blank. According to this method the blank is fixed between a tool and a tail stock. Subsequently the circumferential edge of the circular sheet metal blank is bent by a first metal working roll towards the side of the tool by an angle of more than 180° to form a curl. This curl is radially flattened with a second metal working roll. Subsequently the flattened curl is pressed against the tool with a gear cutting roll and shaped to form an external tooth system.

13 Claims, 2 Drawing Sheets

METHOD FOR THE MANUFACTURE OF A MACHINE PART HAVING EXTERNAL TOOTHING

BACKGROUND OF THE INVENTION

1. Field of the Invention

The invention relates to a method for the manufacture of a machine part with external toothing from a circular sheet metal blank. Such machine parts are more particularly used in drive and motor vehicle technology, e.g., as gear parts or as flywheel starter ring gears.

2. Discussion of the Background

Noncutting machining is being used to an ever greater extent in the manufacture of machine parts with external toothing because it is faster and less expensive than material-removing tooth production methods. A noncutting method for the manufacture of an externally toothed gear part can, e.g., be understood from DE 4 205 711 C2. In this known method, the circular sheet metal blank is bent 180° in its circumferential area to form a semicircular curl. Curling takes place on a tool having a slot-like receiving space in which the curl is flattened accompanied by the formation of the teeth. A similar method is described in U.S. Pat. No. 5,237,744. In both of these known methods, a relatively large hollow space is formed in the curl. As this hollow space must be removed when pressing the teeth through the surrounding sheet metal material, due to the limited metal working capacity it is only possible to produce teeth with specific size ratios. Another disadvantage of both methods is that when curling the sheet metal blank, the latter has a relatively large projection. This can lead to the buckling of the blank during upsetting, because the blank is only laterally supported relatively far below.

Another disadvantage of both methods is that the teeth of the metal working rolls have a break-out tendency. The reason for this is the forced synchronization, where the speed ratios of the workpiece and the metal working roll are so set that in the finished workpiece the speed ratios correspond to the synchronization. However, when the gear cutting roll meets the workpiece to be toothed for the first time other rolling diameters exist, such leads to a different transmission ratio from that selected by the synchronization.

SUMMARY OF THE INVENTION

The object of the invention for the manufacture of a machine part with external toothing is to provide a method which can be reliably performed and also offers a high design freedom in the construction of the external toothing.

According to the invention, this object is achieved by a method for the manufacture of a machine part with external toothing from a circular sheet metal blank, in which the latter is fixed between a tool and a tail stock and on its circumferential edge is bent with a first metal working roll towards the side of the tool by an angle of more than 180° to form a curl, which is flattened with a second metal working roll in the radial direction towards the tool and subsequently the flattened curl is pressed with a gear cutting roll against the tool and worked into an external toothing.

A fundamental idea of the invention is to provide the maximum amount of sheet metal blank material on the outer circumference of the gear part to be formed. This is achieved by curling by more than 180° because this step reduces the formation of hollow spaces in the curl by a material filling. This reduction of the hollow space formation is reinforced by the flattening step. During said step the rolled in end is moved further into the hollow space and approaches the lateral face of the non-deformed circular blank. Additionally through the second metal working roll during flattening material is displaced from the center towards the lateral regions of the curl, such reduces the risk of so-called overrolling during the shaping of the teeth. Thus, adequate material is accumulated at the outer circumference of the blank for forming a desired toothing.

Another advantageous aspect of the accumulation of a relatively large amount of material in the outer region of the machine part to be made is the increase in the mass moment of inertia. This is more particularly desirable in the case of flywheel starter ring gears. Moreover, due to the folding or curling according to the invention, a higher stability is achieved in the outer region as compared with a normal 180° curling.

According to an advantageous further development of the invention, the circular sheet metal blank with the curl is flattened by the second metal working roll to an external diameter to which the toothing of the gear cutting roll is matched for forming an integral number of teeth and that either the gear cutting roll or the tool with the blank is driven in rotary manner. In this method the rolling ratio and speeds of the gear cutting roll and workpiece can be freely adapted without any synchronization. It has been found that in this manner, an integral number of teeth is always obtained, i.e., the teeth are such that the first and last tooth pass continuously into one another. The number of teeth is determined by the starting diameter of the sheet metal blank or the curled blank. The starting diameter is understood to mean the diameter at which the toothing of the gear cutting roll rolls on the workpiece at the start of the metal working. Thus, by deriving known, mathematical gear calculation formulas it is possible to determine the initial diameter at which a specific number of teeth is obtained. For example, if it is wished to have one tooth more or one tooth less, it would only be necessary to set a higher or lower said initial diameter. A precise diameter is required to obtain a previously defined number of teeth.

The contact diameter between the gear for shaping and the external diameter of the circular blank defines the number of teeth and the nature of the toothing, e.g., a positive or negative profile offset.

In the case of the method according to the invention there is no need for a complicated synchronization mechanism for the speed matching of the workpiece and gear cutting roll, such as is, e.g., used in the aforementioned conventional gear cutting methods. This economizes on the one hand the not inconsiderable costs for mechanical synchronization and on the other hand no distortions are produced at the time of engagement, as occurs with an external forced synchronization. Thus, due to the low distortion metal working with the method according to the invention the risk of the breaking out of teeth from the gear cutting roll or the workpiece is reduced.

A further increase in process reliability is achieved in that the circular sheet metal blank is contacted and supported on the side of the tail stock by a radially projecting support web. This support web is positioned parallel to the circumferential edge of the metal blank and is flush with the latter. As a result of this lateral support there is no buckling of the blank to the side of the tail stock during the curling process.

A particularly high reliability against lateral bulging of the blank is achieved in that the latter is supported by the support web before the circumferential edge of the blank is bent for curling purposes.

A further improvement to the security against buckling can be obtained in that during the curling process, the circular sheet metal blank is at least temporarily supported on a lateral region of the blank by the support web and the opposite lateral region thereof engages with the tool. Thus, during curling the blank is additionally fixed between the disk-like tool and the support web. Preferably said fixing takes place during the last part of the curling process and the support web can extend up to the outer circumference of the tail stock.

According to another preferred embodiment of the invention, the circumferential edge of the metal blank is bent 270° by the first metal working roll. Due to this rolling in or curling of the circumferential edge to a ¾ circle, a particularly high material concentration on the outer circumference is achieved.

A good material distribution at the outer circumference of the machine part to be produced can be obtained in that during the flattening of the curl, the latter is supported on the second metal working roll by two spaced support webs. The spacing of the two support webs corresponds to the width of the disk-like tool, plus the width of the circular sheet metal blank. To ensure a precise curl width, the two support webs have the same diameter, one of the support webs being able to engage on the side of the tool. During flattening the shape of the curl is approximately the same as the external toothing contour.

Advantageously the curl is pressed on the tool only at the time of shaping the external toothing. This allows a free movement of the inner, rolled-in part of the curl towards the non-deformed area of the blank.

It is also advantageous that during the shaping of the external toothing, the curl is supported by two spaced support webs on the gear cutting roll. These support webs are constructed similar to those of the second metal working roll, so that a precisely defined toothing width can be attained when shaping the teeth. The tooth system is rolled in by means of a gear cutting roll with a lateral chamber formed thereon and which advantageously prevents material flow.

In another further development of the invention, it is advantageous that the circular sheet metal blank is heated. This can in particular take place by induction or by a laser. As a result of heating, the structural deformations in the blank are reduced during the individual metal working steps, so that a premature work hardening or exhaustion of the deformation capacity of the material is prevented. The blank can be heated before or during the performance of the method.

According to another embodiment of the invention, the external toothing can be hardened. Hardening can take place under heat action and the aforementioned heat sources can be used.

Obviously the finished teeth can also be hardened by other known hardening processes, e.g., flame or diffusion hardening.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE REFERRED EMBODIMENT

Figure 1:
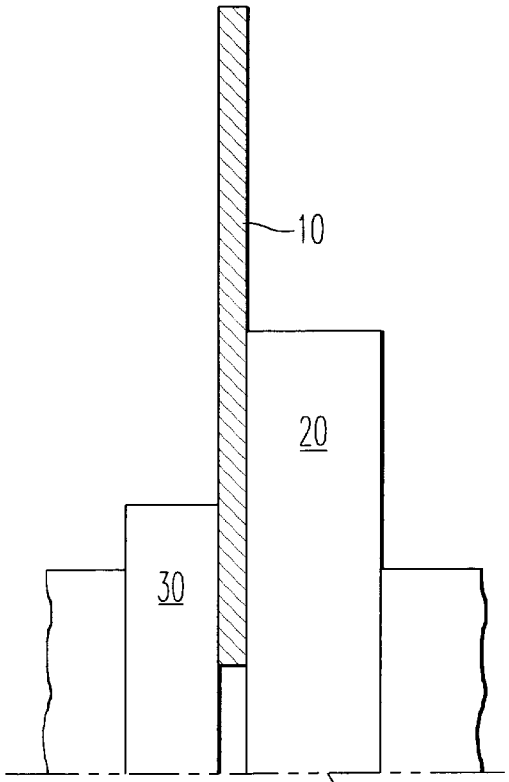
FIG. 1 is a cross-sectional view of the non-deformed circular sheet metal blank in its fixed state.

In FIG. 1 a circular sheet metal blank 10 is fixed between a tool 20 and a tail stock 30. At the start of the process the blank 10 is rotated by a disk-like tool 20 and the tail stock 30 is rotated about a rotational axis 21.

This is followed by the radial infeeding of a first metal working roll 40, which is mounted in a rotary manner about a further rotation axis 41 parallel to the rotation axis 21. For carrying out deformation or shaping, the first metal working roll 40 has a shaped part 42 with a semicircular groove, which is located between a tail stock-side support 43 and a tool-side support web 44. The support web 43 has a larger diameter than the support web 44, so as to come as quickly as possible into contact with the side 13 of the blank 10 facing the tail stock 30. This ensures that the blank 10 does not bulge towards the side of the tail stock 30 at the start of the curling process.

During this step, the circular sheet metal blank 10 is rolled in at the edge, or more precisely bent by approximately 180° to form a curl 11. As a result of the cross-sectionally semicircular groove of the shaped part 42 and the infeeding of the metal working roll 50, the circumferential edge of the blank 10 is bent in a circular manner so that the outer edge 14 is tapered and bent towards the side of the blank 10 facing the tool 20. Due to the bending process there is also a material reinforcement in the radially outer region 15 of the curl 11.

Figure 3:
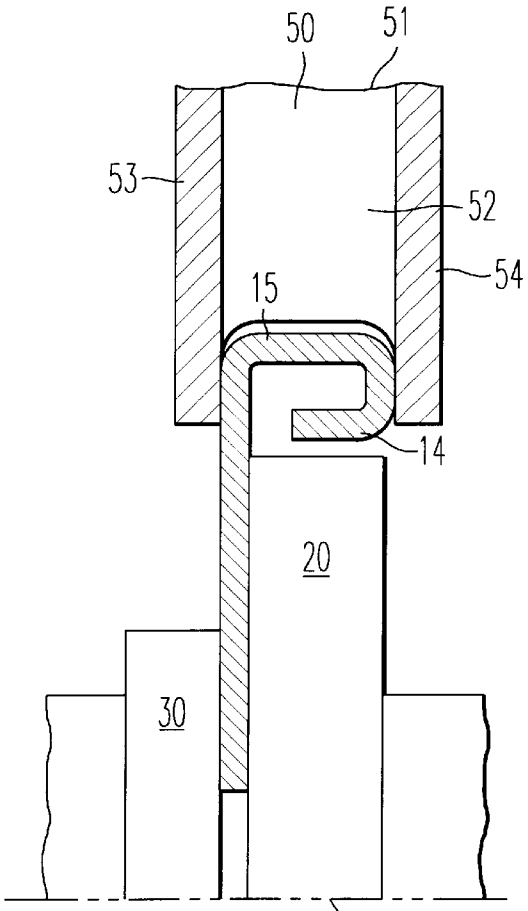
FIG. 3 sets forth a cross-sectional view of the circular sheet metal blank on flattening the curl.
Figure 2:
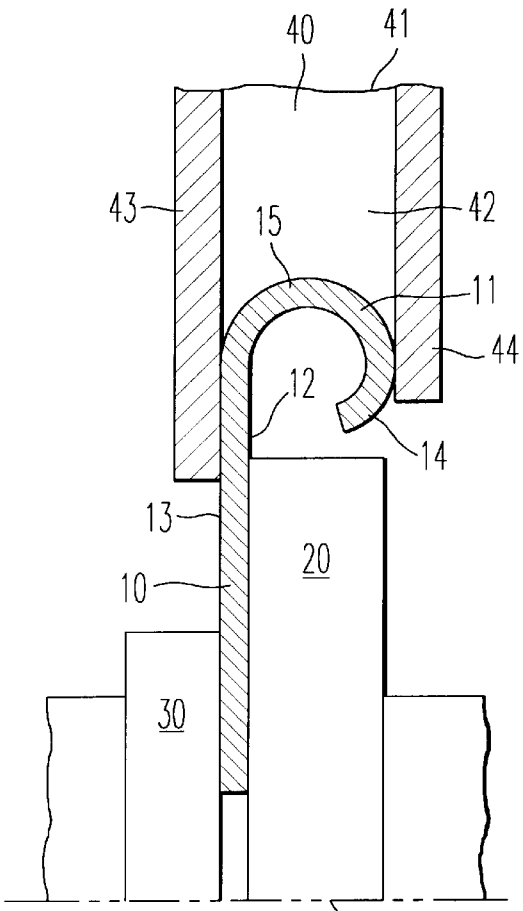
FIG. 2 illustrates a cross-sectional view of the circular sheet metal blank during the curling process.

In a second metal working step shown in FIG. 3, the curl 11 is further worked or deformed by a second metal working roll 50 rotatable about a rotation axis 51. A virtually disk-like shaped part 52 of the second metal working roll 50 flattens the radially outer edge of the curl 11, so that there is a material distribution towards the outside. This material displacement is limited by support webs 53, 54 on the outside of the second metal working roll 50. The object of this process is to ensure that for the following method step there is not excessive material in the center of the curl 11, which would lead to so-called overrolling. The leading edge 14 of the curl 11 is guided further towards the tool-side surface of the blank 10, thereby reducing the size of the hollow space surrounded by the curl 11. In this method step shown in FIG. 3 of flattening the curl 11, the leading edge 14 is not yet located on the circumferential edge of the disk-like tool 20.

Figure 4:
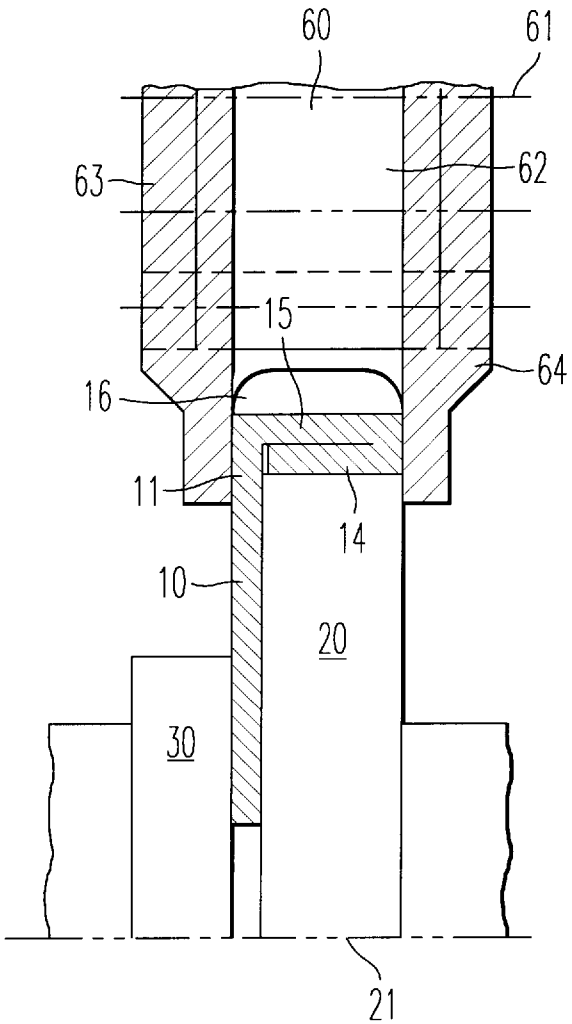
FIG. 4 is a cross-sectional view through the gullet of a toothed blank.

Only during the next method step shown in FIG. 4 is the curl 11 pressed onto the circumferential edge of the tool 20, the material of the leading edge 14 flowing back in the lower region of the metal working zone approximately to the non-deformed region of the blank. In this step, which is performed by a gear cutting roll 60, rotatable about a rotation axis 61 and having a shaped part 62 and two lateral support webs 63, 64, the teeth of the shaped part 62 form the toothing 16 on the outer circumference of the circular sheet metal blank 10.

Figure 5:
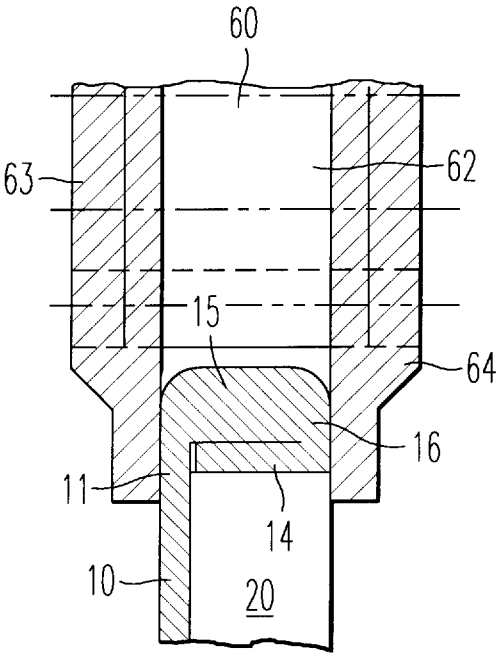
FIG. 5 is a partial cross-sectional view through the crest of a toothed blank.

FIG. 4 shows a sectional view taken through a dedendum, a shaped tooth profile being visible on the blank 10. FIG. 5 shows a section through a shaped tooth of the tooth system 16. A joint consideration of FIGS. 4 and 5 makes it clear that both the radially outer edge 15 and also the bottom, leading edge 14 of the curl 11 is flattened by the gear cutting roll 60. Considered in cross-section, this material rises to the right and left of a tooth of the tooth system 16, as can be seen in FIG. 5, so that both the leading edge 14 and the radially outer edge 15 of the curl are thicker than originally, so that the material flows from the dedendum into the crest.

In this final method step, the curl 11 is pressed onto the circumferential edge of the tool 20. As the support webs 63, 64 of the gear cutting roll 60 extend during gear cutting up to the vicinity of the tool 20, the tool-side support web engaging on a lateral face of the tool 20, there is no need for forming a separate reception space on the tool 20. Although with a corresponding definition of the diameter of the curled circular sheet metal blank 10 and the gear cutting roll 60 no synchronization of the rotation speeds of blank 10 and roll 60 are required, the method according to the invention can obviously also be performed in the case of a mechanical synchronization of the rotation speeds.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. Method for the manufacture of a machine part with an external toothing from a circular sheet metal blank, which comprises:

fixing the sheet metal blank between a tool and a tail stock;

bending the sheet metal blank on a circumferential edge thereof with a first metal working roll towards a side of the tool by an angle of more than 180° and forming a curl;

flattening the radially outer surface of the curl by using a second metal roll; and subsequently pressing the flattened curl with a gear cutting roll against the tool and shaping the curl to form the external toothing.

2. Method according to claim 1, wherein the flattening of the curl comprises flattening the curl to an external diameter to which is matched the toothing of the gear cutting roll for forming an integral number of teeth and driving one of the gear cutting roll and the tool in a rotary manner with the blank.

3. Method according to claim 1, which comprises contacting and supporting the sheet metal blank on the side of the tail stock by a radially projecting support web of the first metal working roll.

4. Method according to claim 3, which comprises supporting the circular sheet metal blank by the support web before the bending of the circumferential edge of the blank to form the curl.

5. Method according to claim 3, which comprises at least temporarily supporting, during forming of the curl, the circular sheet metal blank by the support web on a lateral region of the blank, and engaging an opposite lateral region of the blank with the tool.

6. Method according to claim 1, which comprises bending the circumferential edge of the circular sheet metal blank by substantially 270° by the first metal working roll.

7. Method according to claim 1, which comprises, during flattening of the curl, supporting of the curl on the second metal working roll by two spaced support webs.

8. Method according to claim 1, which comprises pressing the curl only onto the tool during the shaping of the external toothing.

9. Method according to claim 1, which comprises supporting, during the shaping of the external toothing, the curl on the gear cutting roll by two spaced support webs.

10. Method according to claim 1, which comprises heating the circular sheet metal blank by induction heating.

11. Method according to claim 10, which comprises heating the circular sheet metal blank by using a laser.

12. Method according to claim 1, which comprises hardening the external toothing.

13. Method according to claim 1, wherein the rolling in of the toothing takes place by the gear cutting roll being provided with a lateral chamber preventing material flow.

* * * * *